United States Patent [19]

Quaif

[11] 4,027,761

[45] June 7, 1977

[54] MATRIX PRINT HEAD IMPACT ENERGY CONTROL

[75] Inventor: Richard S. Quaif, Dryden, N.Y.

[73] Assignee: NCR Corporation, Dayton, Ohio

[22] Filed: Oct. 21, 1975

[21] Appl. No.: 624,502

[52] U.S. Cl. ..... 197/1 R; 101/93.03; 101/93.05; 101/93.15; 361/169

[51] Int. Cl.[2] ..... B41J 3/04

[58] Field of Search ..... 197/1 R; 101/93.04, 101/93.05, 93.03, 93.14, 93.28, 93.29, 93.32–93.34, 110, 111, 93.15; 317/123–128; 178/23 R, 30; 318/599

[56] References Cited

UNITED STATES PATENTS

| | | | |
|---|---|---|---|
| 3,443,514 | 5/1969 | Schwartz | 101/93.14 |
| 3,513,774 | 5/1970 | Pawletko et al. | 101/93.14 |
| 3,628,102 | 12/1971 | Jauch et al. | 101/93.29 X |
| 3,690,431 | 9/1972 | Howard | 197/1 R |
| 3,719,781 | 3/1973 | Fulton et al. | 178/30 |
| 3,743,911 | 7/1973 | Erler | 318/599 |
| 3,825,681 | 7/1974 | Cederberg et al. | 178/23 R |
| 3,866,533 | 2/1975 | Gilbert et al. | 101/93.14 |

*Primary Examiner*—Ralph T. Rader
*Attorney, Agent, or Firm*—J. T. Cavender; Wilbert Hawk, Jr.; Jeffrey P. Morris

[57] ABSTRACT

A matrix printer impact energy control is disclosed wherein the impact energy supplied to the drive solenoids of matrix print heads is maintained substantially constant notwithstanding variations in the printer power supply output. The hammer power supply voltage is monitored and coupled, together with a derived reference voltage to a summing amplifier which is then pulse width modulated to produce a pulsed hammer drive output having constant print energy. The print energy may be increased to provide multiple copy printing capability. A single impact energy control circuit controls all of the print hammer of each print head. Synchronization of the pulse width modulator is provided by a variable frequency clock from which the pulse width modulator trigger frequency is derived.

12 Claims, 37 Drawing Figures

MATRIX PRINT HEAD IMPACT ENERGY CONTROL

CROSS REFERENCE TO RELATED APPLICATION

MATRIX PRINT HEAD REPETITION RATE CONTROL, Copending Application Ser. No. 624,503, NCR Docket No. 2222, filed on even date herewith, invented by Richard S. Quaif and John D. Hays, assigned to NCR Corporation.

BACKGROUND OF THE INVENTION

1. Field of the Invention

The present invention relates generally to the field of matrix printing wherein alphanumeric characters are printed in dot matrix form by the energization of one or a plurality of wire elements, or print hammers, in response to digitally generated character data for driving and controlling or more printing heads, each head including one or more of such print hammers, for sequentially printing lines of characters on a print receiving medium. The matrix printing field also includes non-impact printing such as thermal printing. More particularly, the present invention relates to a matrix printer and a novel print hammer impact energy control therefore for varying the impact energy of the print hammers automatically to compensate for variation in input power supplied to the hammer drive solenoids, thereby insuring substantially constant impact energy of each printing wire as its associated head traverses the printing medium. The present invention also relates to an externally synchronized pulse width modulated circuit for deriving a variable width pulsed output for controlling the hammer impact energy in accordance with changes in input power. The present invention also relates to matrix printing of multiple copy forms.

2. Description of the Prior Art

Modern high speed matrix printers must have print head control capable of printing a variety of character fonts at ever increasing and varying speeds, under varying input power conditions and yet maintain reliability of operation, cost efficiency, durability, uniform character spacing and width and constant print quality. While the actual print head construction does not form a part of the present invention, many configurations are possible, both with respect to the number of print wires and print wire orientations. A typical matrix print head wire matrix drive is illustrated by U.S. Pat. No. 3,690,431.

A timing control of the prior art for a matrix printer is illustrated by U.S. Pat. No. 3,719,781. A dual three-station matrix printer of the prior art is illustrated by U.S. Pat. No. 3,825,681.

A servomotor pulse width control circuit capable of compensating for variations in supply voltage is described by U.S. Pat. No. 3,743,911.

SUMMARY OF THE INVENTION

The invention is directed to a novel matrix print head element impact energy control circuit and the matrix printing control logic incorporating the impact energy control circuit. The impact energy hammer drive voltage supplied to the hammer banks of one or more printing heads in a multiple head matrix printer is maintained constant by adjusting the pulse width of the hammer drive applied to the print-wire drive solenoids in accordance with and proportional to power supply variations. Inputs signals from the power supply and a derived voltage reference are added by a summing amplifier having an output voltage which is pulse width modulated in synchronism with the system timing to generate a properly timed and variable width pulsed output that is of the correct shape for constant impact printing irrespective of power supply variations. The impact energy may be easily increased to enable the printing of multiple copy forms.

It is therefore an object of the invention to provide an improved matrix printer impact energy control.

It is another object of the invention to provide an improved print hammer drive generation circuit for a single or multiple-head matrix printer capable of operation with one, two, or three print heads for printing at multiple stations.

It is another object of the present invention to provide a print energy control for supplying substantially constant impact energy simultaneously to all of the print hammers of a printing head, notwithstanding variations of the input power supply.

It is yet another object of the present invention to provide one or more pulse width modulated hammer drives to the heads of a matrix printer having an unregulated or coarsely regulated power supply.

The foregoing and other features and advantages of the invention will become apparent from the following detailed description of a preferred embodiment of the invention together with the accompanying drawings.

DESCRIPTION OF THE PREFERRED EMBODIMENT

Figure 1:
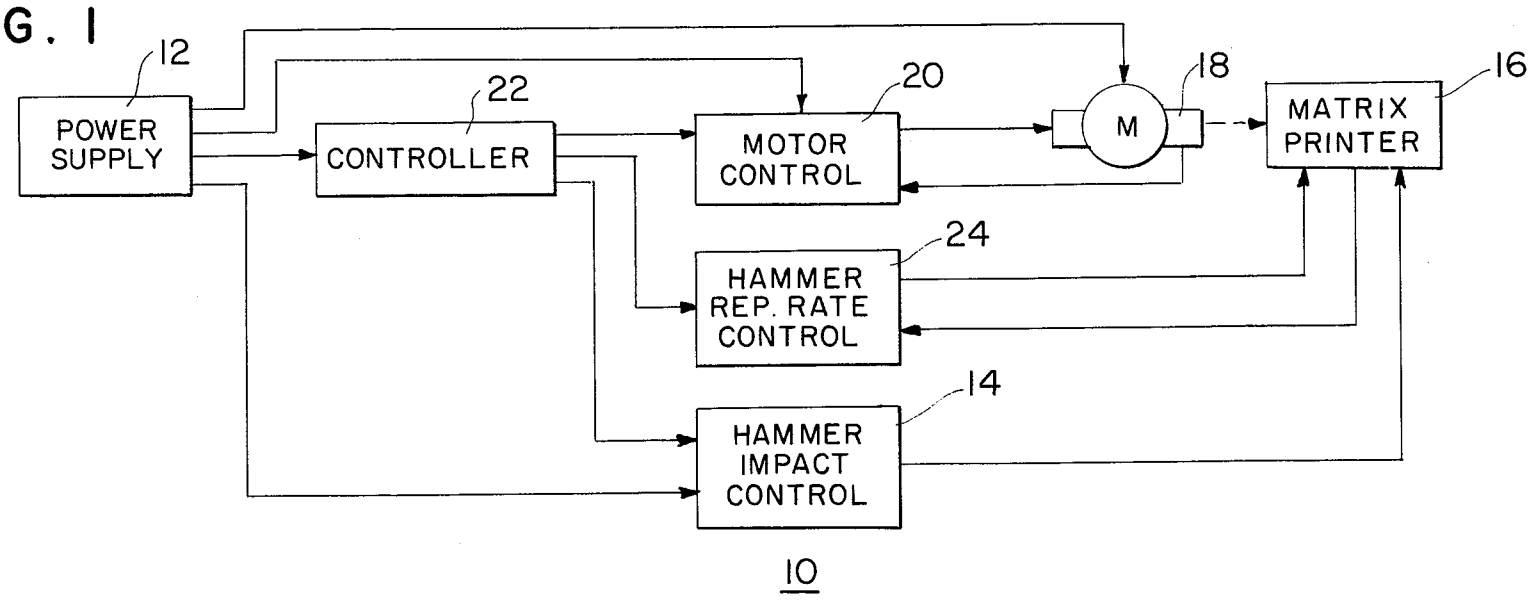
FIG. 1 is a simplified block diagram of a matrix printer control embodying the hammer repetition rate and impact energy control of the present invention.

Referring now to FIG. 1, a simplified block diagram of the control circuitry for a matrix printer having a multiple or a single printing head capability, is illustrated generally at 10. As previously mentioned, it is desirable in matrix printing to maintain a substantially constant print wire impact energy as the print head containing the print wires traverses the printing media during printing of alphanumeric characters at varying speeds and under varying input power conditions resultant, for example, from variations in the input power supply 12 output voltage. A novel hammer impact energy control circuit 14, described in detail with respect to FIG. 3, controls the hammer drive pulse width in accordance with power supply variation and, when necessary, provides sufficient energy for printing multiple copy forms with one or more printing heads.

An exemply matrix printer having a control therefor in accordance with the present invention is matrix printer 16, being a serial impact three-station printer utilizing to sevenwire print heads for generating dot matrix character fonts having an NX7 dot configuration. As is well known, the two print heads are utilized to print at slip, journal and receipt stations. In the alternative, a single printing head could serially print at the three stations or three heads could be used, one for each station. The control circuitry of the present invention is equally applicable to any of the above printer head configurations. The carriage upon which the print heads are mounted is driven by a reversible dc motor 18 under the control of motor control 20 for accelerating motor 18 up to print velocity and for maintaining a substantially constant velocity during printing. Motor control 20 varies the speed of dc motor 18 by means of a duel feedback from the driven carriage and from power supply 12 to maintain constant motor speed during power supply variations, without conventional regulation circuitry. The output of a one shot multivibrator, a function of motor speed, is summed in a summing integrator with the power supply feedback signal to derive a motor control signal which is applied to a pulse width modulator, the output of which is the motor drive. Thus, the feedback one-shot multivibrator output serves as the time standard for comparison with the motor feedback. High motor speed causes the one-shot to have a high average output and slow motor speed causes a low average output from the one-shot, which operates as a simple tachometer. The above simplified motor control 20 is described by way of example only, as other known motor controls may be utilized in conjunction with the present invention, and therefore, the motor control per se does not form a part of the present invention.

The print head impact energy is maintained substantially constant during printing by the novel hammer impact control circuitry 14 of the present invention. The print head energy, in the form of electrical pulses, is applied to the individual matrix wire solenoid drivers in the print head, and is maintained constant notwithstanding variations in the output voltage or current of power supply 12. The hammer impact energy control circuitry 14 is described more particularly with reference to FIG. 3; however, generally, this circuitry consists of a summing amplifier which adds the power supply 12 output with increasing pulse width inputs and which has an output applied to a pulse width modulator. The pulse width modulator, in response to the summing amplifier output, generates control pulses modulated with the correct control pulse widths and synchronized by a synchronization signal supplied from the printer controller 22, and derived from a variable frequency clock.

The print hammer repetition rate control 24 varies the repetition rate of each of the print wire solenoid drivers in each of the printing heads of matrix printer 16 such that the width of the printed alphanumeric characters is maintained substantially constant. The character pattern and sequence is controlled by character data from controller 22 and its associated memory, while clocking pulses are counted by the repetition rate control 24 over a character pulse time period, which varies in accordance with the desired printing speed, i.e., short for high speed and long for low-speed and converted into a digital code representative of the character repetition frequency. The digital code is converted to an analog control signal which serves as the voltage control for a voltage controlled oscillator, the variable frequency output of which VCO is gated to the control 24 and to the print head data output gating registers for loading of character data therein at a hammer repetition rate proportioned to the carriage speed, which, as previously mentioned, is determined by the speed of motor 18, and in synchronism with the pulse width modulated hammer drive output.

Figure 2:
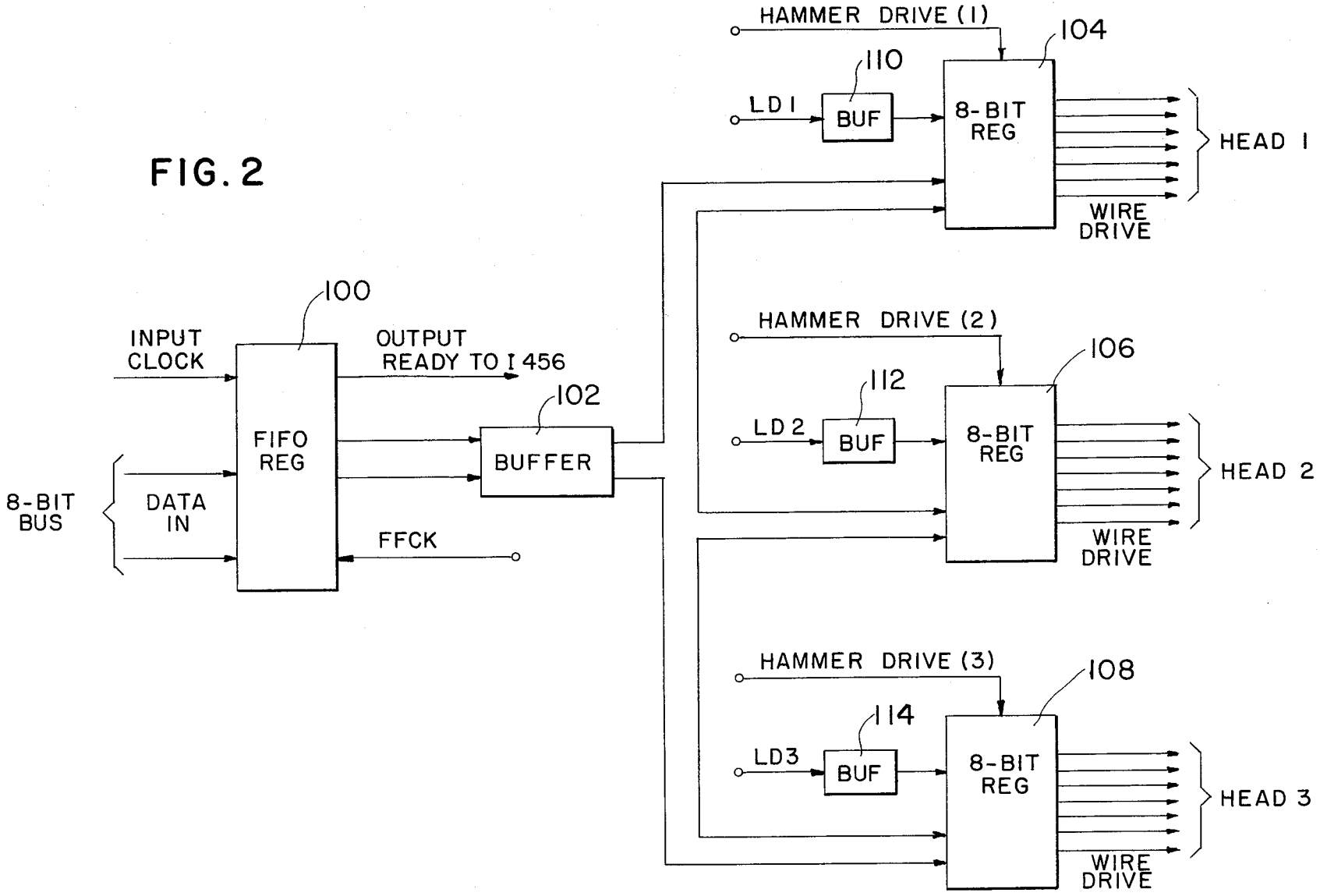
FIG. 2 is a block diagram of a logic interface for coupling hammer firing data from a controller to a matrix printer.

Referring now to FIG. 2, the circuitry for coupling hammer selection data from the controller 22 to the print wire drive solenoids of the print heads is illustrated. Each wire may be independently energized by logical "1" outputs of the 8-bit output latching registers associated with each head. Thus, energization of hammers one through seven of head 1, for example, permits printing an NX7 matrix font, where N is any integer, and at a repetition rate for the illustrated circuitry of 1.3 milliseconds.

Hammer firing data for character generation is coupled to a first-in-first-out (FIFO) shift register 100 via an 8-bit wide parallel data bus from the controller data storage, clocked by an input clock which indicates that data on the control bus is valid and for the FIFO 100. The FFCK clock is an output clock being used by the FIFO register to clock new data to the output of register 100, through suitable output buffer gates 102 to the eight-bit latching output register 104 for head 1, register 106 for head 2 and register 108 for head 3. The individual print wire drivers are darlington amplifiers supplied with base current by registers 104, 106 and 108. CMOS noninverting buffer 110, clocks register 104 of head 1 with data from output buffer 102, buffer 112 loads register 106 of head 2 with data from output buffer 102 and buffer 114 loads register 108 of head 3 with data from output buffer 102. Load signals LD1, LD2 and LD3, derived by division of the variable clock, and clock data through buffers 110 through 114 respectively, which data selectively enables the three generated hammer drive signals for the printing heads (hammer drives 1, 2 and 3) described in detail with respect to FIG. 3 from hammer impact control circuit 14 to registers 104, 106 and 108, respectively. The OUTPUT READY signal from FIFO register 100, utilized by the system timing, indicates that valid data exists on the FIFO outputs. Each of the seven wire drive outputs for each of registers 104, 106 and 108 fires the print wires for a time duration determined by the respective hammer drives having pulse widths variable in accordance with power supply variations.

Figure 3:
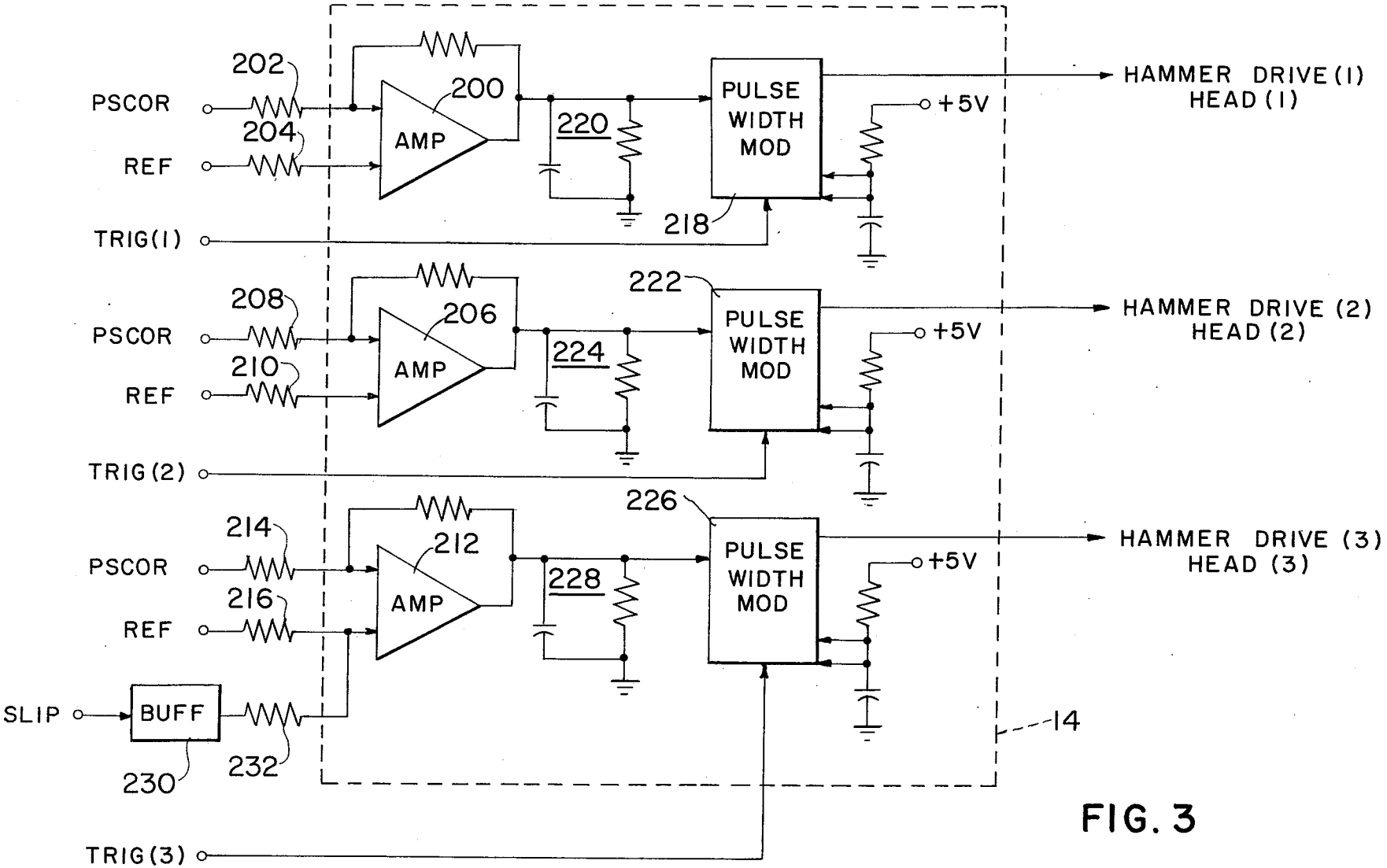
FIG. 3 is a block and schematic diagram of a hammer impact energy control circuit in accordance with the present invention.

Referring now to FIG. 3, the hammer impact energy control 14 is illustrated, which control adjusts the print wire energization hammer drives for the print heads to compensate for power supply variation by generating variable pulse width outputs. A summing amplifier 200, preferably an operational amplifier (such as LM3900 of National Semiconductor) has coupled thereto across input resistance 202 a power supply correction signal (PSCOR) derived by sampling the output voltage of power supply 12. A reference voltage (REF) is summed with the power supply correction signal by the amplifier 200 as a bias supply, and is coupled thereto across input resistor 204. The same correction signal and reference voltage are summed by operational amplifier 206 for head (2) across input resistances 208 and 210 and by operational amplifier 212 for head (3) across input resistances 214 and 216. PSCOR is derived for a power supply output voltage of +28 volts +10 percent − 15 percent while REF is derived from −12 volts ± 10 percent for a typical power supply.

Pulse width modulator 218 has coupled to the input thereof the output from amplifier 200 after filtering by a filter network 220 and a synchronization signal (TRIG 1) for initiating the modulator 218 output pulses for hammer drive (1). Typically, the output of modulator 218 will be equal to 15.73 (28-V) +420 microseconds ± 2 microseconds, where V equals, PSCOR (ideally, 28 volts). The hammer drives (2) and (3) are derived in the same manner as is hammer drive (1), with pulse width modulator 222 having coupled thereto the output of summing amplifier 206 after filtering by filter network 224 and with pulse width modulator 226 having the output of summing amplifier 212 coupled thereto after filtering by filter network 228. The leading edge of the hammer drive (2) of modulator 222 is triggered by TRIG (2) while the leading edge of hammer drive (3), for head (3), the slip station of the matrix printer, is triggered by TRIG (3). The head (3) hammer drive summing amplifier 212 may include additional slip width correction via the SLIP voltage input to buffer 230, the output voltage of which buffer is coupled across resistor 232 to the amplifier 212 to provide additional drive for printing multiple copy forms. Pulse width modulators 218, 222 and 226 may comprise, for example, model 555 timer circuits manufactured by Signetics and operable in a monostable mode to be triggered with a continuous pulse train. TRIG (1), (2) and (3) are variable frequency pulses, as they are phased signals derived by division of HCK, as explained with reference to FIG. 8.

Figure 6:
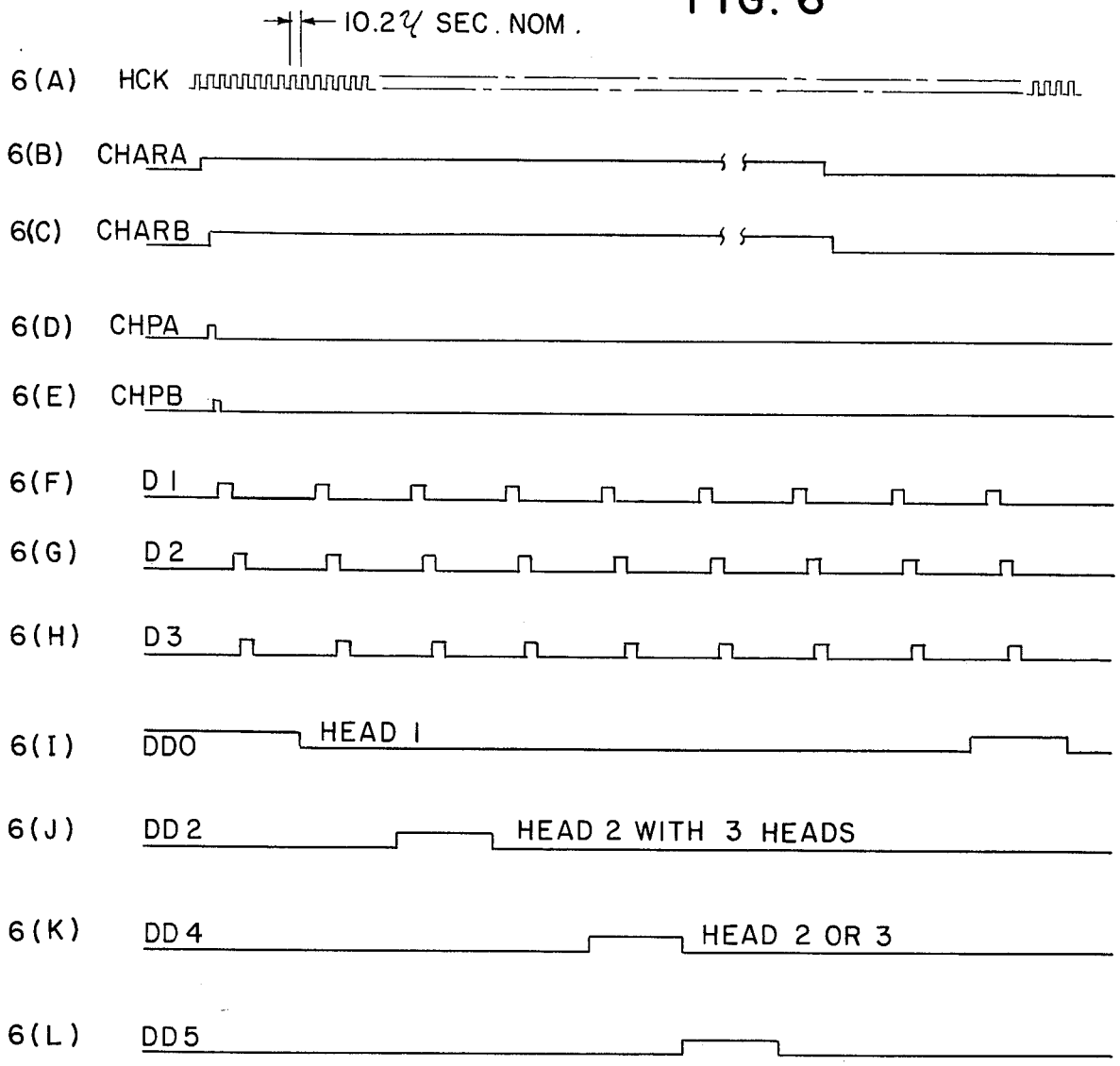
FIGS. 6(A) through 6(L) are various waveforms illustrative of the timing and operation of the present invention.
Figure 7:
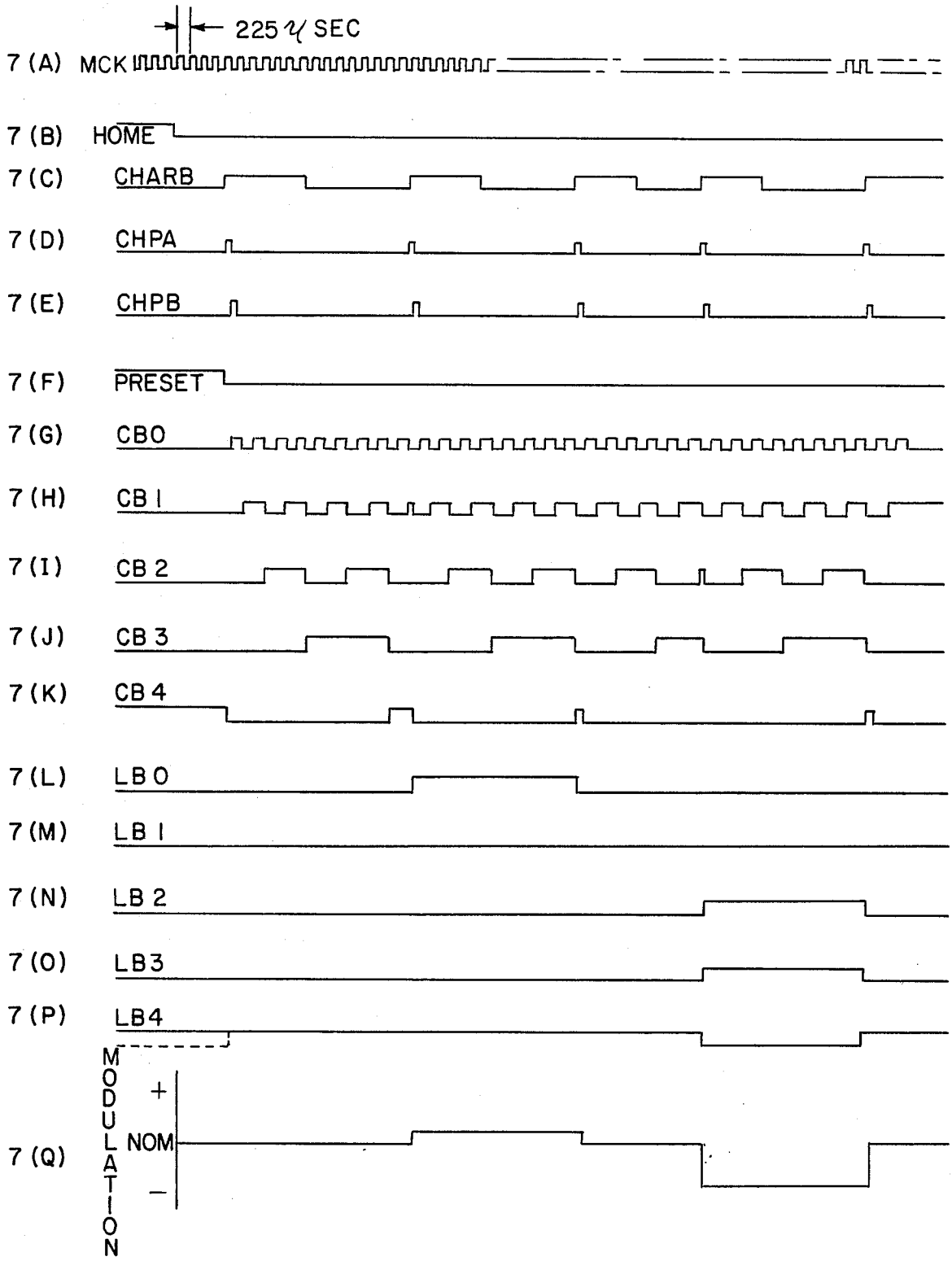
FIGS. 7(A) through 7(Q) are further various waveforms illustrative of the timing and operation of the present invention.

The hammer repetition rate control 24 illustrated in block diagram by FIG. 4 and schematically by FIG. 5, together with the hammer control timing circuitry of FIG. 8 will now be described. The waveforms illustrated by FIGS. 6 and 7 appear at various points in the description of the schematics of FIGS. 5 and 8, and are defined as follows:

| | | |
|---|---|---|
| 6(A) | HCK | A variable hammer clock of approximately 10.2 microseconds used in deriving all print head timing. |
| 6(B) | CHAR A | derived from input character pulses and synchronized with HCK. |
| 6(C) | CHAR B | derived from input character pulses and synchronized with HCK. |
| 6(D) | CHPA | derived from CHAR B and used to load latch 306. |
| 6(E) | CHPB | derived from CHPA and used to reset counter 304. |
| 6(F) | $D_1$ | first decoded count of HCK decoded by decoder 460. |
| 6(G) | $D_2$ | second decoded count of HCK decoded by decoder 460. |
| 6(H) | $D_3$ | third decoded count of HCK decoded by decoder 460. |
| 6(I) | DDO | first decoded counts of HCK ÷ 8 |
| 6(J) | DD2 | third decoded counts of HCK ÷ 8 |
| 6(K) | DD4 | fifth decoded counts of HCK ÷ 8 |
| 6(L) | DD5 | sixth decoded counts HCK ÷ 8 |
| 7(A) | MCK | a reference frequency of 225 microsec. for comparison with the character pulses. |
| 7(B) | HOME | A loading signal for preloading latch 420 and derived by OR'ing HOME A, B and C of the print head (home positions at each station). |
| 7(C) | CHAR B | same as 6(C) |
| 7(D) | CHP A | same as 6(D) |
| 7(E) | CHP B | same as(E) |
| 7(F) | PRESET | used to preset the count of counter 304 and to disable MCK. |
| 7(G) | CBO | output of counter 418 |
| 7(H) | CB1 | output of counter 418 |
| 7(I) | CB2 | output of counter 418 |
| 7(J) | CB3 | output of counter 418 |
| 7(K) | CB4 | output of counter 418 |
| 7(L) | LBO | output of latch 420 |
| 7(M) | LB1 | output of latch 420 |
| 7(N) | LB2 | output of latch 420 |
| 7(O) | LB3 | output of latch 420 |
| 7(P) | LB4 | output of latch 420 |
| 7(Q) | MODULATION | the output of VCO 312. |

Figure 4:
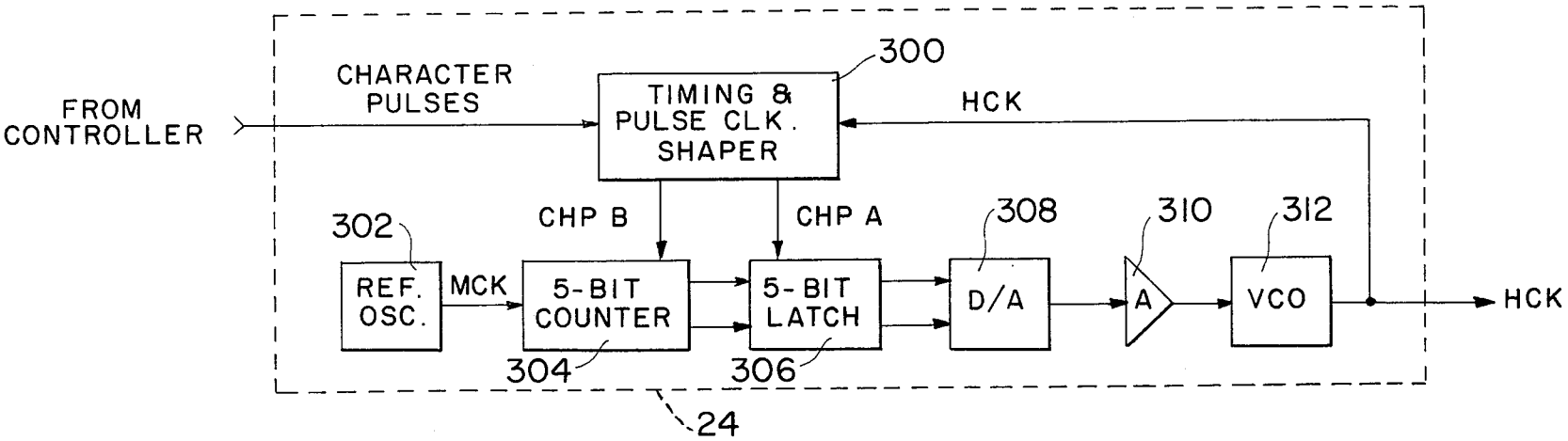
FIG. 4 is a block diagram of a hammer repetition rate control for varying the hammer firing rate with printing speed in accordance with the present invention.

Referring now to FIG. 4, a novel print hammer repetition rate control is illustrated, in which the hammer repetition rate is varied proportionally to the speed at which the print head is incremented across the printing medium to product constant width printed characters at varying printing speeds. Clock pulses are counted over each character pulse time period having a pulse repetition frequency corresponding to the time period of the characters, the input data signal generating a digital code which is converted to an analog voltage for controlling a voltage controlled oscillator, the output of which VCO is a variable freuency clock proportional to the printing speed.

Character pulses from the controller 22 are coupled to a pulse shaping circuit 300 which functions as a digital filter and synchronizes a pulsed output representative of the character time duration with HCK to produce two clock pulses, CHPA and CHPB illustrated by FIGS. 6(D) and 6(E) which two clock pulses are synchronized with the leading edge of the incoming character pulses. A free-running oscillator, reference oscillator 302 having a period of 225 microseconds, or any frequency substantially greater than the character pulse repetition frequency, is used for generating 7×7 character fonts or, alternatively, a 227 microsecond period for generating 5×7 character fonts, the reference frequency or master clock (MCK) illustrated by FIG. 7(A). A 5-bit counter 304, present to HOME (the initial print head position) counts to 16 during a character pulse period, after which the counter 304 is cleared by the character print pulse B (CHP B) clock derived by pulse shaper and digital filter 300, with clearing of counter 304 occurring after the output of counter 304 is loaded into a five-bit latch 306 with character print pulse A (CHP A) from shaping circuit 300. The five-bit latch 306, loaded by CHP A, stores the count for the digital to analog converter 308, a resistive ladder circuit for generating 32 different analog outputs corresponding to the five-bit input thereto from latch 306. The analog voltage output from digital to analog converter 308 is amplified by the VCO driver circuit, a buffer operational amplifier 310 which produces the proper gain for voltage controlled oscillator 312. The VCO 312 output, HCK, illustrated by FIG. 6A, is normally approximately 10.2 microseconds which, when divided by 64 produces a 650 microsecond nominal hammer repetition rate. Typically, VCO 312 is TTL logic, however, CMOS logic is utlized in D/A 308. The "printing speed" is sometimes referred to as the printer cycle time, which is the time required for the carriage to traverse the print line and return to its home or start position. Obviously, the printer cycle time is data dependent, in that it varies with the number of columns of characters printed and with the number of printing heads.

Figure 5:
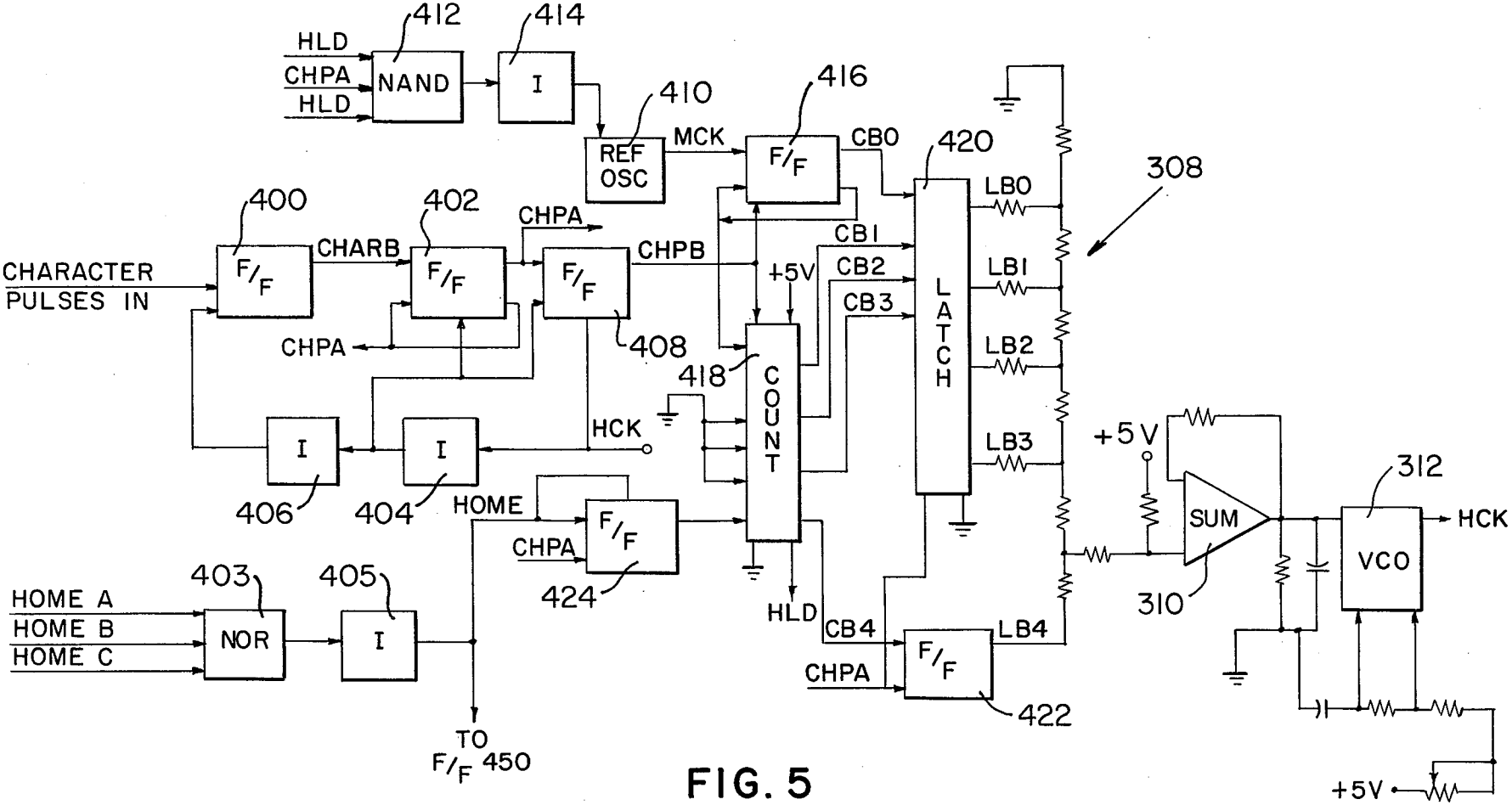
FIG. 5 is a schematic diagram of the hammer repetition rate control described with respect to FIG. 4.

Referring now to FIG. 5, the hammer repetition rate control circuit 24 of FIG. 4 is illustrated in greater detail.

The character pulse shaping circuit 300 is comprised of a pair of D type flip-flops 400 and 402, with flip-flop 400 receiving input character pulses at its data input and having an output of CHARB coupled to the input of flip-flop 402. The variable HCK output of VCO 312, which may comprise a Signetics model 555 timer, is applied to the input of inverter 404, which inverter is coupled to the input of inverter 406 for re-inverting the HCK and utilizing the HCK as the clock input to flip-flop 400 for synchronizing the incoming character pulses. The latch 306 loading signal CHPA illustrated by FIG. 6(D) is derived from the output of flip-flop 402. Signal CHPA is also coupled to the data input of another D type flip-flop 408 from which CHPB illustrated by FIG. 6(E), the counter 304 reset signal is derived. Flip-flop 408 is clocked by the inverted HCK output of inverter 404. Flip-flops 400 and 402, together with inverters 404 and 406, comprise a digital filter circuit.

Reference oscillator 302 (FIG. 4) is comprised of a timer 410 (FIG. 5) for generating the master clock, MCK as described. Reference oscillator timer 410 is gated ON by CHPA from flip-flop 402 applied to one input of a two input NAND gate 412, the other input to NAND gate 412 being a hold signal indicative of counter overflow for stopping the MCK generation. Inverter 414 inverts the output of NAND 412 and couples same to the reference oscillator 410. Oscillator 410 output MCK (225 microsecond for a 7×7 font) clocks counter 304 (FIG. 4) which is comprised of D flip-flop 416 and 5-bit counter 418 (FIG. 5) for counting to sixteen each character period. The counter 418 outputs CB0, CB1, CB2 and CB3 illustrated by FIG. 7(G) through (J), the digital code, which are loaded into the five (5)-bit latch 420, after which counter 418 is cleared by CHPB. Loading of latch 420 is accomplished with CHPA pulses from flip-flip 402 via flip-flop 422, which is a part of the overall counter circuit 304 and has count CB4 shown by FIG. 7(K) coupled thereto. Thus, the output of counter 418, the data input to latch 420, also drives flip-flop 422, clocked by CHPA, the output of which is coupled to the D/A ladder network 308 of FIG. 4 together with outputs of latch 420, LB0, LB1, LB2 and LB3 illustrated by FIG. 7(L) through 8(O). Counter 418 is presettable to HOME status via the output of initialization D flip-flop 424, clocked at CHPA and having coupled to the data input thereof the HOME output of inverter 405 illustrated by FIG. 7(B) and coupling LB4 to the ladder.

The analog output of resistance ladder 308 is applied as the positive input to a buffering operational amplifier 310. The output of amplifier 310, the control voltage for VCO 312, a 555 timer, varies the VCO 312 output HCK with carriage speed (HOME A through C pulse data).

Figure 8:
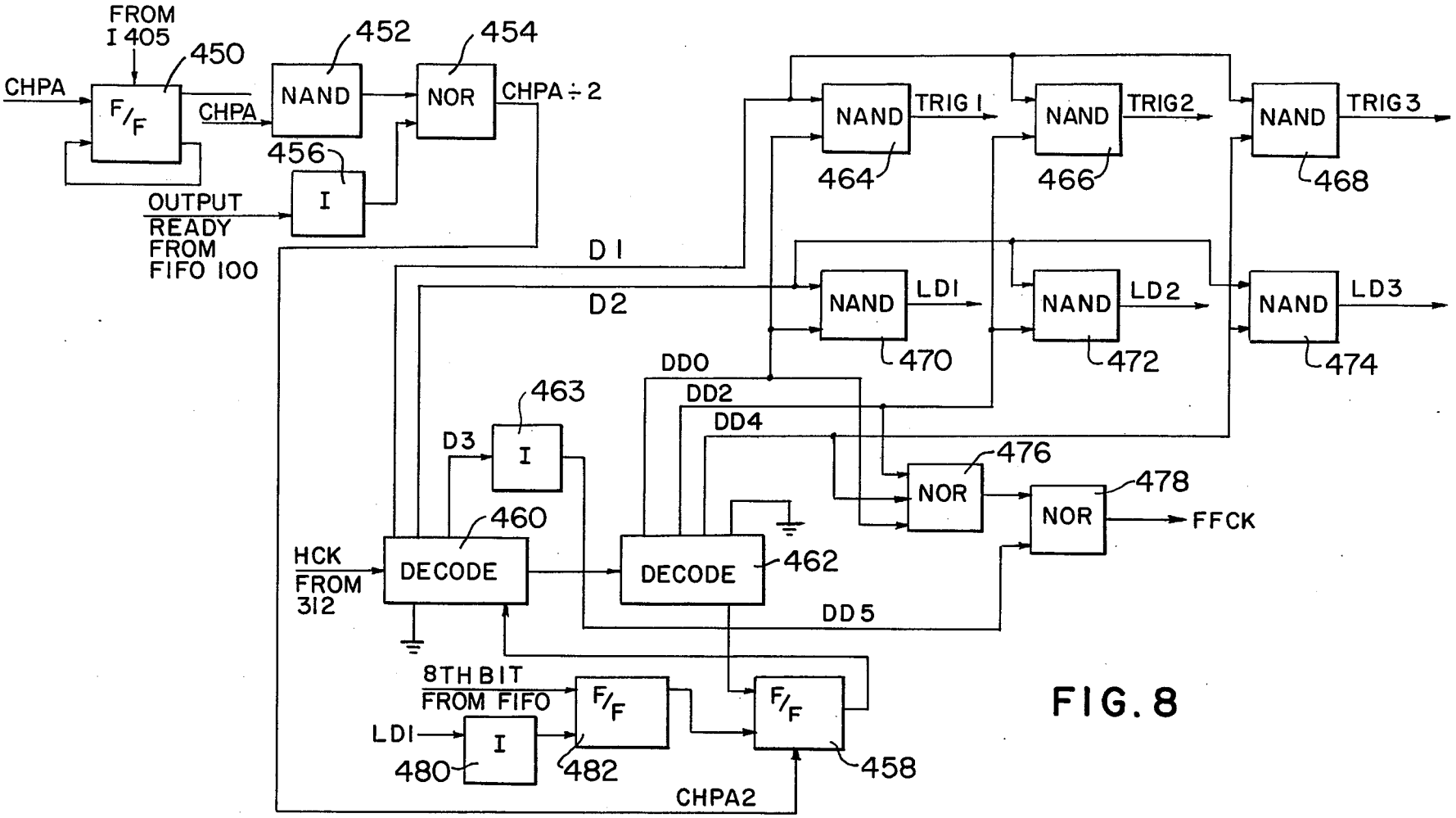
FIG. 8 is a schematic diagram of a timing circuit for generating certain of the waveforms described with respect to FIGS. 6 and 7.

Referring now to FIG. 8, the hammer timing circuit utilized for generating TRIG (1), TRIG (2) and TRIG (3) which initiate HAMMER DRIVE (1), HAMMER DRIVE (2) and HAMMER DRIVE (3) respectively; LD1, LD2 and LD3 which load the 8-bit hammer drive output registers 104, 106 and 108 with data from the FIF0 register 100; and FFCK are disclosed. It is to be understood that the timing and synchronization circuitry of FIG. 8 is exemplary only, as many other timing circuit variations are possible once HCK is derived. The fundamental timing function is to load the hammer output registers with hammer data sequentially and is synchronized with the hammer drive.

The HOME output of inverter 405 which preloads latch 420 also serves as a reset signal for a D flip-flop 450 clocked by CHPA and having an output coupled to one input of a two-input NAND gate 452, the other NAND input being CHPA for generating a CHPA 2 output wave form which occurs every other CHPA and is reset to start the printing of a character by a printing head. The output of NAND 452 is NOR'ed by NOR gate 454 with the inverted OUTPUT READY pulse from FIFO 100 to insure that CHPA2 is generated only when valid character data is present on the FIFO outputs. Inverting is accomplished by inverter 456. Print starting signal CHPA2 is coupled from the output of NOR gate 454 to a D flip-flop 458. The illustrated timing removes the CLEAR from the output registers 104, 106 and 108, loading them with hammer firing data from the FIFO register 100. The three printing heads are fired sequentially; hence, three signals at the same frequency, but of different phase are provided.

The variable HCK from VCO 312 is coupled to a 3-bit counter decoder 460 for generating three phased outputs: $D_1$ illustrated by FIG. 6(F), the second decoded count of HCK; $D_2$ illustrated by FIG. 6(G), the third decoded count of HCK; and $D_3$ illustrated by FIG. 6(H), the fourth decoded count of HCK is provided by another 3-bit counter decoder 462 to derive HCK divided by eight and to provide DD0, DD2, DD4 and DD5 illustrated by FIGS. 6(I), 6(J), 6(K) and 6(L), respectively, and which signals are the first, third, fifth and sixth decoded counts of HCK divided by eight. The above described generated timing signals are used to fire the hammers each 1.3 milliseconds by providing a 10.2 microsecond divided by 64 "window" for hammer firing of 650 microseconds in three phases for triggering the three hammer banks. Print characters have dots in any given row only every other window. With three printing heads, the sequencing is as indicated by FIGS. 6(I) through 6(K). The phased trigger signals TRIG (1), TRIG (2) and TRIG (3) for initiating the hammer drives for heads one, two and three, respectively, shown by FIG. 3, are derived by combining $D_1$ and DDO at NAND gate 464 to derive TRIG (1); $D_1$ and DD2 at NAND gate 466 to derive TRIG (2); and $D_1$ and DD4 at NAND gate 468 to derive TRIG (3). The phased loading signals LD1, LD2 and LD3 for loading data from FIFO to the hammer drive output registers for each head are derived by combining D2 and DD0 at NAND gate 470 to derive LD1; D2 and DD2 at NAND gate 472 to derive LD2; and D2 and DD4 at NAND gate 474 to derive LD3. The FIFO clock FFCK is derived at combining DDO, DD2 and DD4 at NOR gate 476, the output of which NOR gate is applied as one input to a two-input NOR gate 478; the other input thereto being DD5. The output of NOR gate 478 is FFCK. Loading signal LD1 after inverting by inverter 480 is used to clock the eighth bit from FIFO 100, a signal stored which is indicative of an end of character, through flip-flop 482, the output of which is applied to flip-flop 458 to enable the three bit decoders 460 and 462 to be reset by the output of flip-flop 458.

While the invention has been shown and described with reference to a preferred embodiment thereof, it will be understood that persons skilled in the art may make modifications thereto without departing from the spirit and scope of the invention as defined by the claims appended hereto.

What is claimed is:

1. In a matrix printer having at least one print head containing one or more print elements energized by a pulsed drive signal for printing matrix characters in accordance with character data as the printing head is moved across a printing medium, a print element drive control circuit supplied with electrical power from a power supply for varying said print element drive signal in accordance with variation of the power supply output voltage comprising:

means for generating a variable frequency clock signal whose frequency varies directly with the speed of movement of the printing head;

a summing amplifier for sensing the output voltage of said power supply and a reference voltage;

means responsive to said clock signal for deriving a plurality of synchronized trigger signals of the same frequency as said clock signal at different phases;

character data source coupled to a plurality of output registers;

means responsive to said trigger signals for pulse width modulating the output of said summing amplifier to drive a pulse drive signal;

and means for selectively coupling said pulse drive signal through said output registers for simultaneously energizing said print elements at each of said print heads in accordance with said data coupled to the output register associated with each of said print heads respectfully.

2. In a matrix printer, a print element drive control circuit in accordance with claim 1 wherein said plurality of hammer drive signals are coupled individually to journal station, receipt station and slip station print heads.

3. In a matrix printer, a print element drive control circuit in accordance with claim 2 wherein the print element of each of said receipt, journal and slip station print heads comprises a plurality of print hammers which are driven by a plurality of hammer drive signals initiated by said respective trigger signals.

4. In a matrix printer, a print element drive control circuit in accordance with claim 2 wherein two print heads driven by said print element drive signals print at any two of said stations simultaneously.

5. In a matrix printer, a print element drive control circuit in accordance with claim 2 wherein a single print head driven by said print element drive signal prints sequentially at each of said three stations.

6. In a matrix printer, a print element drive control circuit in accordance with claim 1, further comprising:

means for increasing said reference voltage applied to said summing amplifier for increasing said print element drive signal.

7. A matrix print head impact energy control circuit for a multi-station matrix printer in which the print head moves across a printing medium comprising:

means for generating a variable frequency clock synchronization signal whose frequency varies directly with the speed of movement of the print head;

a source of electrical power;

a summing amplifier for each print station for sensing a signal indicative of the output voltage of said power source for summing said voltage signal together with a variable reference voltage and for generating an output signal;

frequency divider means for driving said synchronization signal into three phased trigger signals;

pulse width modulation means for each station responsive to said output signal and one of said phased trigger signals to output a pulse width modulated hammer drive signal;

a source of character data coupled to an output register in each print station;

and means responsive to said clock signal for selectively coupling said hammer drive signals through said output register for simultaneously energizing a print head at each of said printing stations in accordance with said character data coupled to the output register.

8. A matrix print head impact energy control circuit in accordance with claim 7 wherein each of said printing stations has associated therewith a print head having one or more print hammers selectively energizable by said hammer drive signal coupled thereto; and wherein said output register comprises a latching register for coupling said hammer drive signal to said print hammers in accordance with said character data coupled thereto.

9. In a matrix printer operable to move across a printing medium and having a plurality of print heads, each print head having a plurality of solenoid driven print hammers for printing alphanumeric characters on the printing medium, a hammer impact control comprising:

means for generating a plurality of data signals representing alphanumeric character information, said data signals having a variable pulse-repetition frequency varying directly in accordance with the speed of the moving member;

means responsive to said data signals to generate a variable frequency clock having a frequency corresponding to the frequency of said data signals;

a source of electrical power;

a summing amplifier for each print head for sensing a signal indicative of the output voltage of said power source for summing said voltage signal with a variable reference voltage and for generating an output signal;

frequency divider means for dividing said variable frequency clock into three phased trigger signals;

pulse width modulation means for each print station responsive to said output signal and one of said phased trigger signals to output a pulse width modulated hammer drive signal;

means for coupling the data signal to a plurality of hammer drive output circuits;

and means for loading said data signals into said hammer drive output circuits in synchronization with said hammer drive signals such that the solenoid driven print hammers are operated by said hammer drive signals.

10. In a matrix printer in accordance with claim 9, a hammer impact control wherein said means for coupling said data signals to said plurality of hammer drive output circuits comprises a first-in first-out data register having a plurality of data outputs.

11. In a matrix printer in accordance with claim 10 wherein said hammer drive output circuits each comprises:

a latching register having a data input clocked by one of said loading signals, asid loading signals having a variable period; and wherein the pulse width of said hammer drive signal is varied in accordance with variations in the voltage supplied to said summing amplifier.

12. In a matrix printer having a plurality of print heads, a hammer impact control in accordance with claim 11 wherein each of said hammer drive signals is coupled simultaneously to all of the print hammer solenoids energized in accordance with the data signals coupled to each respective print head.

* * * * *